United States Patent [19]

Schiele et al.

BEST AVAILABLE COPY

[11] 3,995,527

[45] Dec. 7, 1976

[54] CARTRIDGE BELT FEEDING DEVICE FOR AUTOMATIC WEAPONS

[75] Inventors: August Schiele; Siegfried Uhl, both of Augsburg, Germany

[73] Assignee: Keller & Knappich Augsburg Zweigniederlassung der Industrie-Werke Karlsruhe Augsburg Aktiengesellschaft, Augsburg, Germany

[22] Filed: Dec. 19, 1975

[21] Appl. No.: 642,430

Related U.S. Application Data

[63] Continuation-in-part of Ser. No. 440,113, Feb. 6, 1974, abandoned.

[52] U.S. Cl. ..... 89/33 SF; 89/33 E; 89/36 K

[51] Int. Cl.[2] ..... F41D 9/02

[58] Field of Search ..... 89/33 SF, 33 BA, 33 BC, 89/33 CA, 33 E, 36 K

[56] References Cited

UNITED STATES PATENTS

| | | | |
|---|---|---|---|
| 2,474,975 | 7/1949 | Goodhue | 89/33 SF |
| 2,824,497 | 2/1958 | Bond et al. | 89/33 CA |
| 3,076,386 | 2/1963 | Wey | 89/33 SF |
| 3,662,646 | 5/1972 | O'Brien et al. | 89/33 SF |
| 3,687,002 | 8/1972 | Mosli et al. | 89/33 E |

*Primary Examiner*—Stephen C. Bentley
*Attorney, Agent, or Firm*—Allison C. Collard

[57] ABSTRACT

A device for selectively feeding two ammunition cartridge belts to an automatic weapon, such as a rapid firing cannon wherein two cartridge belt feeders are combined at the input of the weapon, comprising a first sprocket wheel engaging the cartridges of one of the belt feeders, a second sprocket wheel engaging the cartridges of the other belt feeder and mounted adjacent to the first sprocket wheel, drive means coupled to the first and second sprocket wheels for selectively turning one of the wheels forwardly toward the weapon and rearwardly away from the weapon, and switching means mounted adjacent to the first and second sprocket wheels for receiving a cartridge from one of the wheels and leading the cartridge toward the breech of the weapon.

7 Claims, 13 Drawing Figures

Fig. 4.
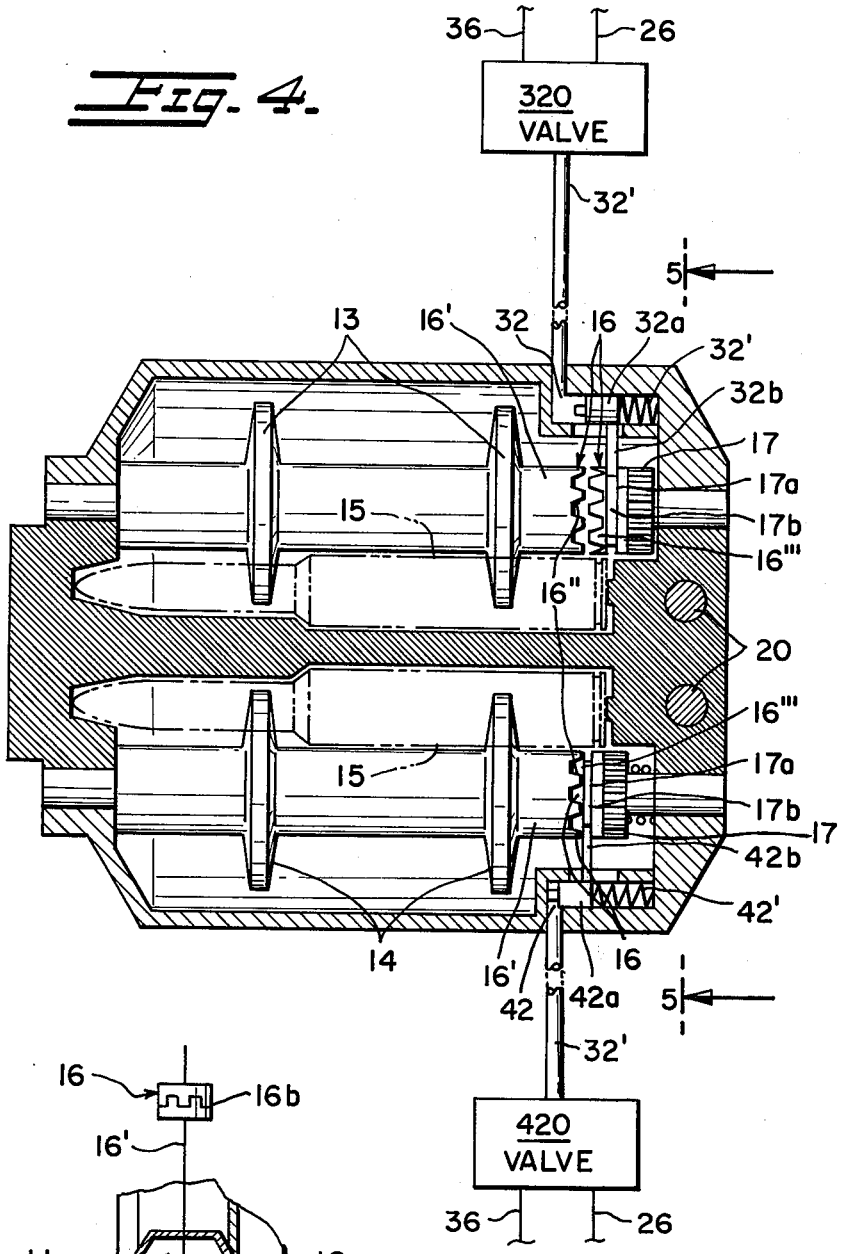
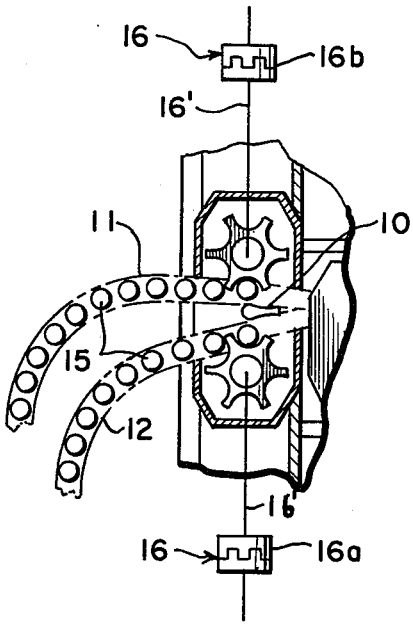
Fig. 8.

CARTRIDGE BELT FEEDING DEVICE FOR AUTOMATIC WEAPONS

The present invention is a continuation-in-part of our co-pending application Ser. No. 440,113 which was filed on Feb. 6, 1974, now abandoned.

The present invention relates to a device for selectively feeding two cartridge belts to an automatic weapon, such as a rapid firing cannon, wherein two cartridge belt feeders run into one channel at the side of the weapon. At the junction of the belts, an adjustment tongue is provided before the cartridge belt feeder or switching means. From the input opening of this cartridge belt feeding device or switching means, the cartridges are fed in their belted condition into the preliminary run of the weapon mechanism.

With this feeding device, cartridges of the same caliber, but of different types, such a normal cartridges or cartridges having fuses, are fed to the weapon. These devices are separate from the weapon and should not be mistaken for "double belt cartridge feeders" in the weapon itself, which require an expensive special construction.

The invention provides a cartridge belt feeder device, which is separate from the weapon as mentioned before, with means to assure a fast and easy insertion and removal of the belts as well as removal of all of the cartridges from the feeding device.

In accordance with the present invention, each of the two cartridge belt feeders is provided with a star-shaped wheel. The star-shaped wheel can be moved forward or in reverse into such a position so that all cartridges in the belt can be retracted behind the adjustment tongue of the feeding or switching means.

The invention provides that when the star-shaped wheel is retracted behind the adjustment tongue, all cartridges which are in the cartridge belt before firing are prevented from entering the feeding device uncontrollably from the mouth piece where the cartridges are fed into the preliminary run or input of the weapon mechanism. No cartridge in the belt can be fired either when the cartridge belts are changed or discharged. Furthermore, the insertion of a fresh belt is also guaranteed by the star-shaped wheels, and can be carried out fast and easily.

In a preferred embodiment of the present invention, a coupling which can be coupled and disconnected is provided in the form of a rack and pinion gear for driving the star-shaped wheel forwardly and rearwardly. The racks can be in the form of hydraulic pistons. Thus, with small hydraulic pistons and high pressures, sufficient displacement forces are obtained and can be controlled electrically, so that the adjusting means and its actuation can be performed in a rather small space. The novel device is mounted in the opening of the elevation gear pivot bearing rung which is used for supplying the ammunition. The novel device is so light that it can be moved together with the movements of the weapon without adding much additional weight on the weapon. The device also operates very rapidly.

In order to exchange the double cartridge feeder, the feeding device is switched into the idle position and the pair of star-shaped wheels for the double cartridge belt feeder for the belt in its operating position is coupled from its disconnected idle position and turned rearwardly in the feeding device by a belt length. If, for example, the pair of star-shaped wheels is provided with six positions, and if six cartridges are in the cartridge belt feeder, the pair of star-shaped wheels is turned back by a full rotation. Therefore, the belt in the operating position is returned behind the adjustment tongue. At this point, the adjustment tongue is switched over and the pair of star-shaped wheels of the other belt is turned forwardly by a complete turn in the feeder device. The pair of star-shaped wheels are then disconnected into the idle position, and the cartridge belt feeder device is again switched on. These operating steps are carried out by a fool proof electro-hydraulic control means, which operates with electrical end switches. An after pressure means for removing jams may also be provided with the novel device at the star-shaped wheels for the double cartridge belt feeding device.

Other objects and features of the present invention will become apparent from the following detailed description when taken in connection with the appended drawings. It is to be understood, however, that the drawings are intended as an illustration only, and are not intended as a definition of the limits and scope of the invention disclosed therein.

In the drawings, wherein similar reference numerals denote similar elements throughout the several views.

Figure 3:
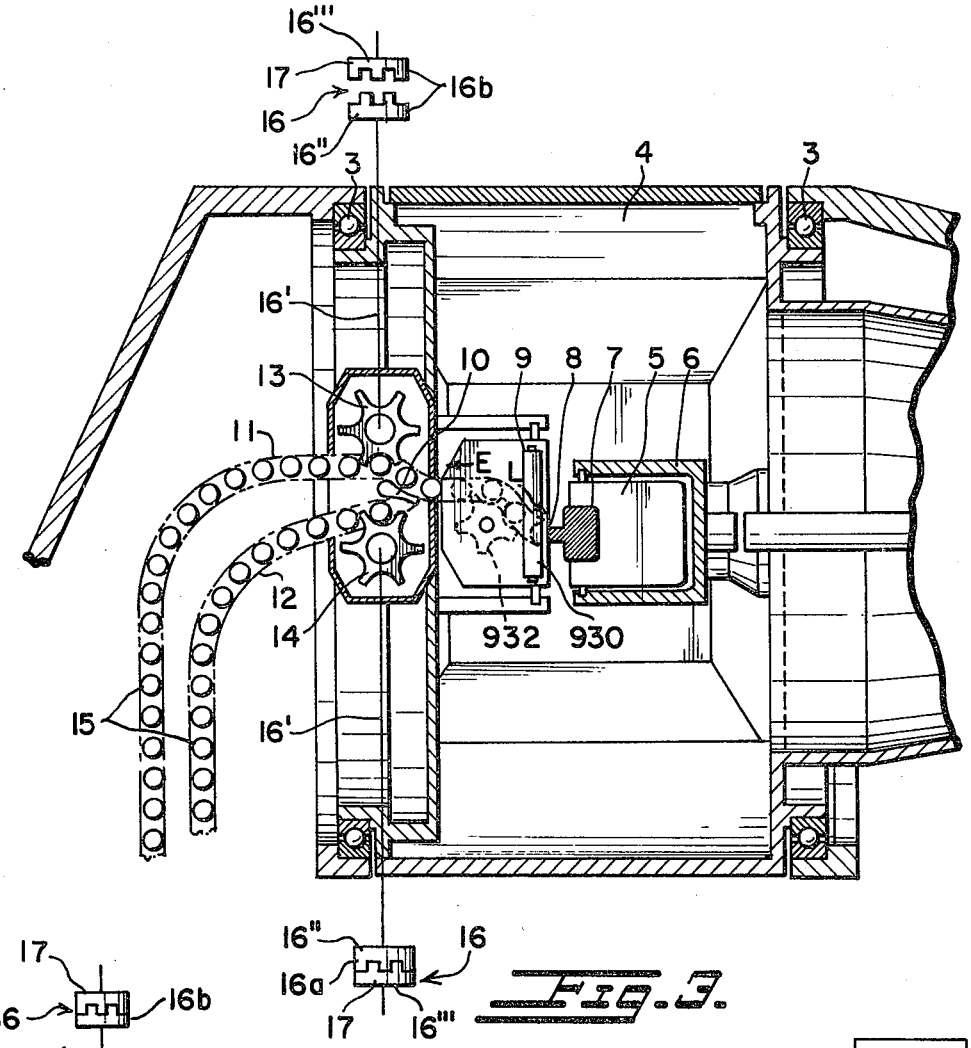
FIG. 3 is a vertical cross-sectional view through the weapon carrier taken along the line B—B of FIG. 2 and with portions of the hydraulic system in selective view.
Figure 7:
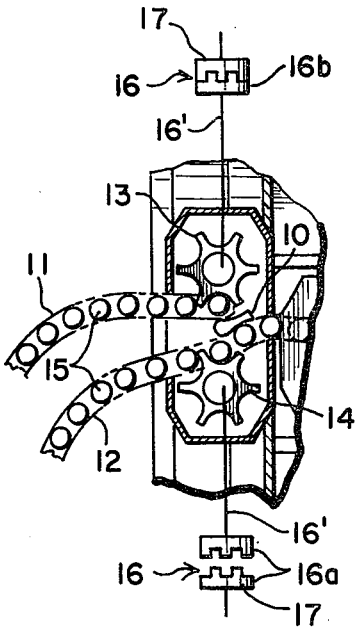
Figure 3A:
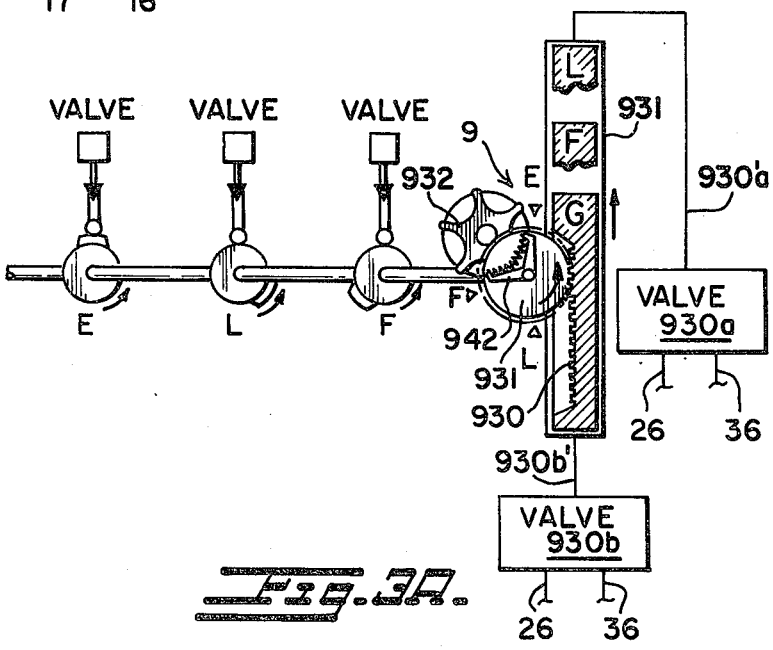
Figure 5:
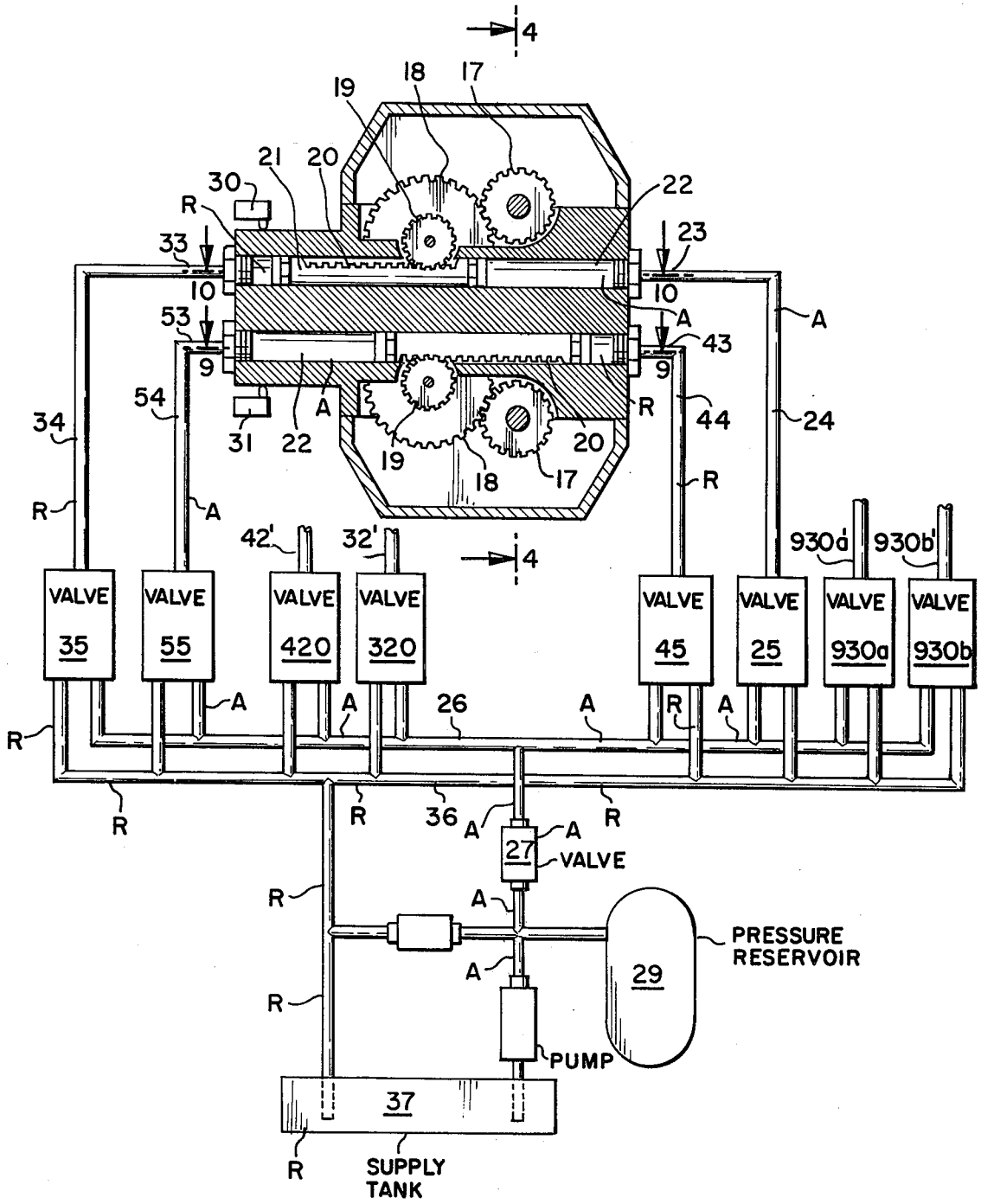
Figure 6:
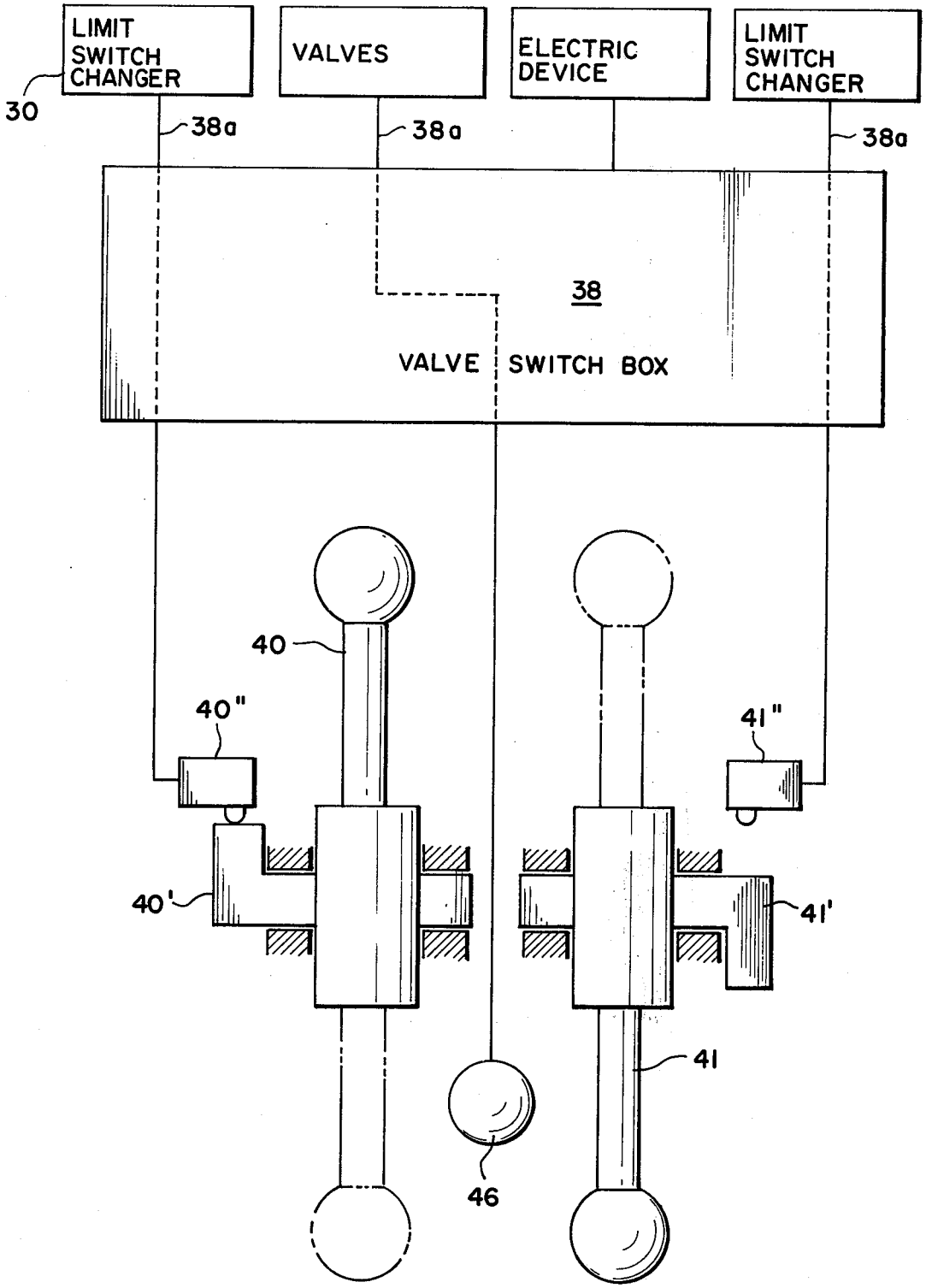
Figure 9:
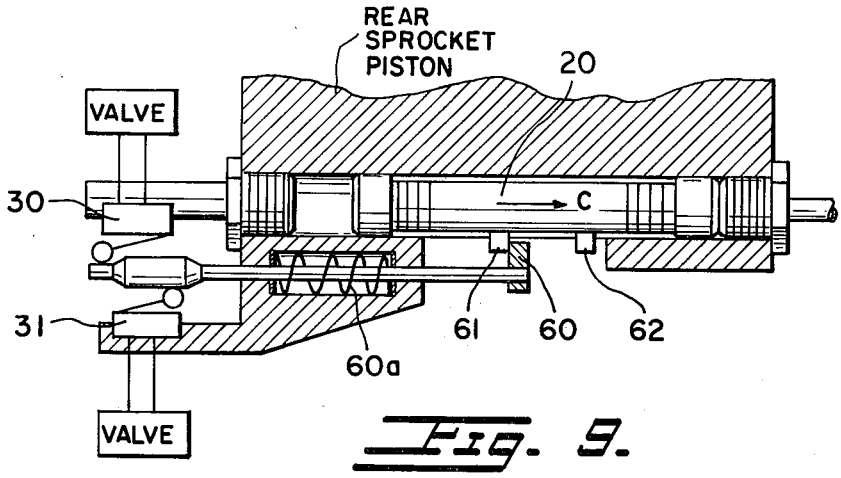

FIG. 3*a* shows an enlarged detail of the belt cartridge feeding device of FIG. 3;

FIG. 4 is a right angle view in accordance with FIG. 3 through the star-shaped wheels of the double belt cartridge feeding device;

FIG. 5 is a cross-sectional view taken along the line 5—5 of FIG. 4;

FIG. 6 shows the manual switching means;

FIG. 7 is a partial view similar to FIG. 3 but in a different operative mode;

FIG. 8 is a partial view similar to FIG. 3 but in a still different operative mode;

FIG. 9 is a cross-sectional view similar to FIG. 5 showing the sprocket piston moved forwardly and taken along lines 9—9 of FIG. 5.

Figure 10:
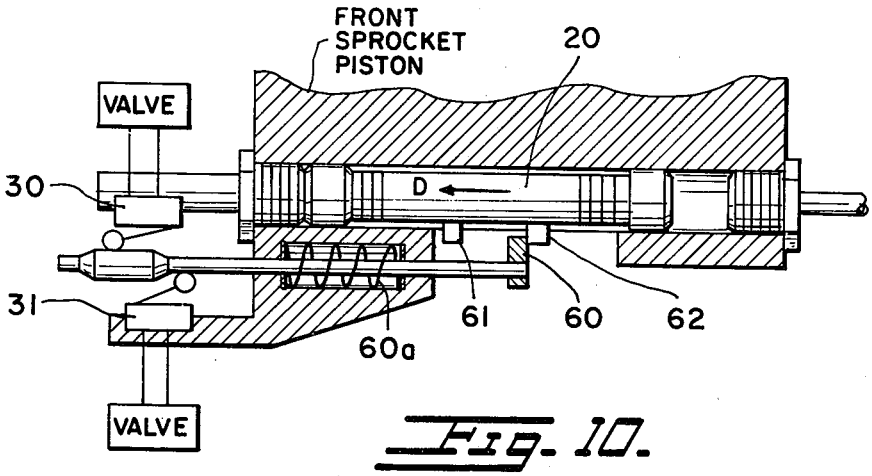
Figure 12:
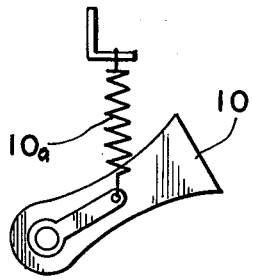
Figure 11:
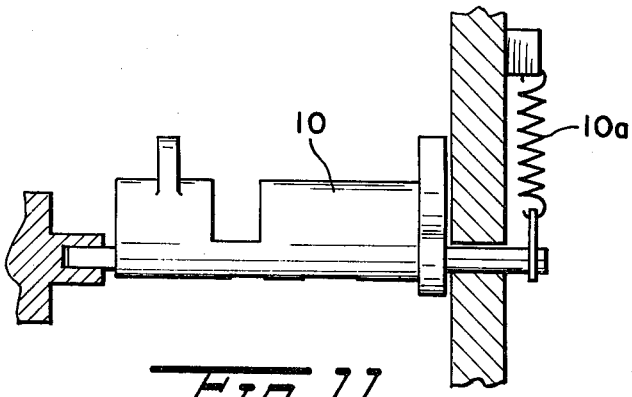

FIG. 10 is a view similar to FIG. 9 showing the sprocket piston moved rearwardly and taken along the lines 10—10 of FIG. 5; and FIGS. 11 and 12 are details of the pivotal adjustment tongue in longitudinal and side view, respectively.

Figure 1:
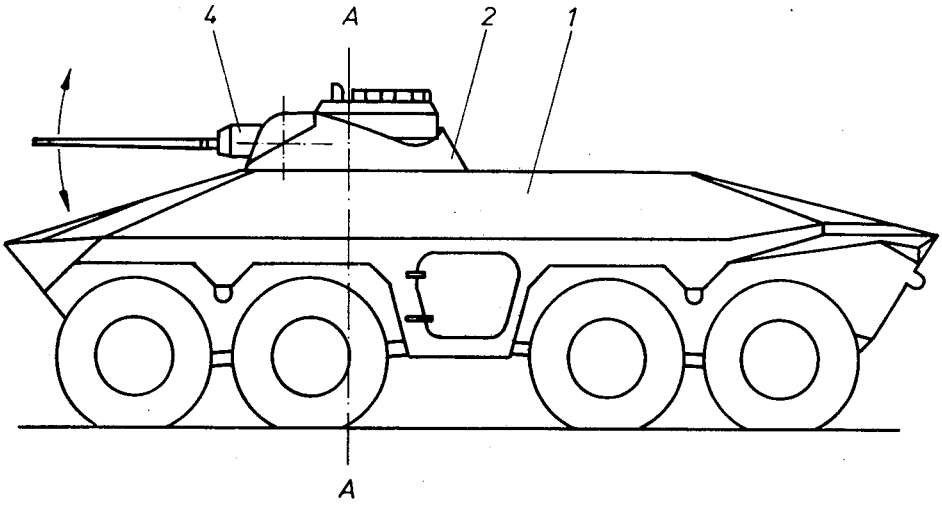
FIG. 1 is a side plan view of a tank vehicle.
Figure 2:
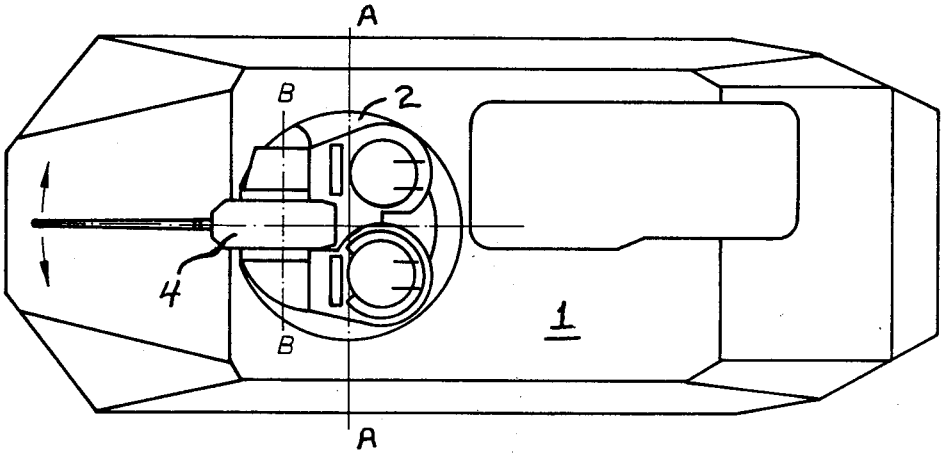
FIG. 2 is a top plan view of FIG. 1.

Referring now to the drawings, and particularly to FIG. 1, there is a tank vehicle 1 with a tank turret 2 rotatably mounted around its vertical axial center line A—A. In FIG. 2, a weapon carrier 4 is mounted in the tank turret, and can be moved upwardly and downwardly along axial line B—B by means of two roller bearing rings 3 shown in FIG. 3. Weapon carrier 4 carries a weapon 5 in its support 6 along the calibration axis of the weapon at the point of intersection of lines A—A and B—B. A cartridge belt feeding device is provided laterally with respect to the preliminary run of a weapon mechanism 7 and a breech 8 so that the feed device is separate from the weapon, but actuated by the weapon.

A device for the double cartridge belt feeder is provided before a feed device 9 and includes two belt feeders 11 and 12 disposed before a pivotal adjustment tongue 10. The associated pairs of star-shaped wheels or sprockets 13 and 14 for the belt feeders are movable in a forward and backward (reverse) direction by a full belt length in the feed device 9. The star-shaped wheels 13 and 14 engage cartridges 15, and are each coupled or disconnected from the cartridge by means of a front gear surface means or clutch 16 and a gear 17, as in FIG. 4. A gear means is provided comprising the gear 17 and toothed intermediary gears 18 and 19 as seen in FIG. 5. A toothed gear rack or cam rod 20 engages the respective gear 19. A piston 21 of the cam rod 20 is fed at both ends (by oil pressure) in a hydraulic cylinder 22. Since FIG. 5 is a sectional view along the line 5—5 of FIG. 4, the cross sections of the two-gear racks or cam rods 20 are shown. FIG. 4 is also a sectional view along the lines 4—4 of FIG. 5.

In a position shown in FIG. 5, the upper hydraulic cylinder 22 is fed with oil pressure at an input 23 by means of a supply line 24 and a valve 25. Valve 25 is supplied with oil pressure by a pump 28 or a pressure reservoir 29, respectively, through a line 26 and a return stroke valve 27. During this operation, the opposite side of the piston at an input 33 is relieved from oil pressure from a valve 35 through a line 34, whereby the oil pressure flows back through a line 36 into a supply tank 37. Likewise, the clutch 16b (FIG. 3) is held open by pressurized oil fed through valve 320 and line 32' into the hydraulic cylinder 32 (FIG. 4), and the clutch **16*a* is engaged by means of the spring 42'. Therefore, the pair of star-shaped wheels 13 for belt 11 are pivoted, as can be seen in FIG. 3, the front gear surface means or clutch 16*b* being disconnected, and the pair of star-shaped wheels 13** runs idly when the weapon is fired.

When sprocket piston 20, 21 moves to the left the double sprocket 18, 19 moves in the clockwise direction as disclosed. The gear 17 along with the coupling halve 16 is coupled to star wheel 13 and moves concurrently counterclockwise. Thereby cartridges 11 are supplied to cartridge belt supply 9 beneath the star wheel 13. (Note FIG. 3, upper ammunition.) For the lower supply, the reverse series of events takes place.

Each clutch 16 is formed of a first claw half 16'' rigidly connected to the cylinder 16', on which the cylinder star wheels 13 are rigidly fixed, as well as, a second claw half 16''' rigidly connected to the axially shiftable gear 17.

The coupling half 16'' as well as star wheel 13 are one unit, i.e., the coupling dogs are milled into the star wheel bushing. The other coupling half 16''' and sprocket 17 are also one unit. When both coupling halves are engaged, the corresponding star wheel turns automatically during the movement of sprocket piston 20, 21. The star wheel is not arrested after the movement procedure.

Star wheels 13 and 14 are mounted idly turning on the axle wheel which is stationary in the housing and are not laterally slidable.

During firing, for example, of the cartridge 15 in belt 11, the star wheels 13 run idle (i.e., the upper clutch **16*b* is engaged); a rotation of the corresponding gear 17 causes a rotation of the corresponding star wheel only during movement of the piston 21.**

The piston rod 21 is also the toothed cam rod 20, as shown in FIG. 5. The coordinated gear 19 engages the cam rod 20. The gear 18 is rigidly connected with the gear 19, and the gear 17 engages the gear 18. Thus, the moving of the upper piston 21, moves gears 19 and 18 and therewith gear 17. This process is more clearly indicated in FIG. 5, the letter A indicating the admittance path of the hydraulic liquid thereto and indicates the return flow of the hydraulic fluid therefrom. Thereby, at the aforementioned displacement of the upper gear rack or cam rod 20 from right to left (FIG. 5 shows the condition after the displacement), the upper gears 19 and 18 are turned clockwise and the upper gear 17 counterclockwise. With such a rotation, the star-shaped wheel 13, which is mounted coaxially with respect to the gear 17 and operatively connected via clutch **16*b*, moves the cartridge belt 11 forwardly to the right by turning counterclockwise (also see FIG. 3**).

Before the above-described process, the cartridge belt 12 must previously be pulled back toward the left side before the cartridge belt 11 can move forwardly. For this purpose, star-shaped wheel 14 should be turned counterclockwise. At this point, the lower gear rack or cam rod 20 is displaced from left to right, the lower gears 19, 18, are turned in clockwise direction, and thereby, the lower gear 17 (which is co-axial to the star gear wheel 14) is turned counterclockwise.

Since, with respect to the adjustment tongue 10, the star-shaped wheel 13 is mounted above the cartridge belt 11, and the star wheel 14 beneath the cartridge belt 12, both star wheels effect counter movement of the cartridge belts (rod 12) by rotation of the star wheels in the same directions.

The gear 17 is also shown in FIG. 4. A detachable connection between the gear 17 and the star wheel or sprocket 13 constitutes the front side gear surface means on clutch 16. This so-called gear or claw coupling constituting a clutch is known per se, and is also shown in FIG. 4. In FIG. 4, the gears 17 carry at their left sides a coupling shoulder **17*a*, with a front sided coupling half of the clutch 16, which coupling half is axially displaceable. When displaced to the right, the clutch 16 is open; and when displaced to the left, the clutch 16 is closed, operatively, coupling the gear 17 to the associated star wheels 13 or 14.**

At this above described position for belt feed 11, the pair of star-shaped wheels 14 for the other belt feed 12 is in a returned position, i.e., the piston inlet side 43 is connected with return flow line 36 through a line 44 and a valve 45. An opposite piston inlet side 53 is connected with the oil pressure line 26 through a line 54 and a valve 55. All the valves shown in FIG. 5 are coordinated to achieve this operation by the control system.

The individual valve switchings are controlled by electric end or limit switches 30 and 31 of the control systems. The coupling operation of the front gear surface means or clutches 16 are operated by hydraulic cylinders 32 and 42, respectively, as shown in FIG. 4.

The actuation of the clutches 16 is carried out by the hydraulic cylinders 32 and 42, in accordance with FIGS. 4 and 5. FIG. 4 clearly shows the pistons **32*a*, 42*a*, in the cylinders 32 and 42 which carry arms (shanks) 32*b* and 42*b* which engage in annular grooves 17*b* in the coupling shoulders 17*a* of the gear wheels 17. The axial reciprocating displacement for the coupling and decoupling is brought about by hydraulic fluid admission or removal from the left-hand sides of the pistons 32*a*, 42*a*, in the hydraulic cylinders 32', 42', at the right sides of the pistons. This is accomplished via valves 320 and 420 and lines 32' and 42', respectively, the valves 320 and 420 being connected to the oil lines 26 and 36 (FIG. 5) as described above. The admission of fluid to the respective hydraulic cylinders 22 is provided as described for the forward movement of the ammunition belt (cartridge belt) 11 (FIG. 3) by the star wheel 13.**

The end limit switches 30 and 31 are only shown symbolically in FIG. 5. FIGS. 9 and 10 show the limit switches in further detail. FIG. 9 illustrates a reciprocal relationship of the control. The piston 20 is moved to position C (with the ammunition in position-star wheel 14, FIG. 3), and a gear shift abutment and bar 60, mounted displaceably-spring 60*a*-biased, is actuated by cam 61 on the piston. Thereby switch 30 is actuated and the corresponding lower shown valve is switched on. At the piston position D gear shift 60 is actuated by cam 62 and limit switch 30 is pushed and the corresponding upper shown valve is switched on. Referring to FIG. 10, when the sprocket piston 20 is moved in the direction D, the upper shown valve is controlled. In fact, the indicated switch lever can be actuated from the end of the pistons 21 in this end position, i.e., in a followup control in dependency on the path, the switches 30 or 31 transmitting electrical impulses to the associated magnetic valves of FIG. 5 which are located in the switch box 38 (FIG. 6), by means of which among the other constructed valve operations, the admittance or relief of the cylinder chambers 32 and 42 takes place for actuating the couplings or clutches 16.

The switching actuation according to FIG. 6 is done by a hand lever 40 for belt feed 11, and a hand lever 41 for belt feed 12 over cams 40' and 41', respectively, onto end switches 40'' and 41'', respectively, which actuate the electrical switching steps in the switch box 38.

FIG. 6 with respect to FIG. 5 indicates that the switch box 38 houses the magnet valves with the associated valves 35, 55, 45, 25, 420, 320, 930*a* and 930*b*, which are schematically indicated in FIG. 5. The lines 38*a* in FIG. 6 are the exits and entrances of the corresponding control lines to the valves, the indicated limit switch changers and the electric device.

The position "Fire ammunition in belt 11" corresponds to the position shown in FIGS. 3 and 5. Here the upper star wheel 13 is free and the lower star wheel 14 is coupled by the clutch 16.

The star wheels 13 and 14 each run idle when in their respective "firing" positions. The transport of the cartridge belt is done exclusively by the star wheel 932 of the cartridge supply 9. In the "unloading" position, the star wheels 13 and 14 are arrested, so that the cartridge belts 11 and 12 do not fall out from the cartridge belt supplies due to their own weight.

The release and arresting of the star wheels 13 and/or 14 is done by means of the front teeth of clutch 16 as shown in the drawing, and shown in form of a claw coupling 16. The actuation of the claw coupling is accomplished by the displaceable pistons 32*a* and 42*a* in cylinders 32 and 42. Extensions 32*b* and 42*b* are mounted on the pistons. The pistons 32*a* and 42*a* are under the force of pressure springs 32' and 42', on the one side, and are admitted by hydraulic fluid, on the other side. In the rest position (also the unloading position), the pressure springs 32' and 42' push pistons 32*a* and 42*a* to the left and arrest the star wheels 13 and 14. This position is also assumed by the pistons 32*a* and 42*b* when the cartridge belts are retracted from the firing position into the unloading position, or if the cartridge belts are moved from the unloading position into the firing position, which is achieved by an alternate admittance to the pistons 21 and valves 25, 35, 45, and only when the ammunition is fired do the corresponding star wheels 13 or 14 run idly and the cartridge belt is moved by star wheel 932. At this point, the pistons 32*a* and 42*a* are moved to the right when admitted by hydraulic fluid through lines 32' and 42' and valves 320 and 420, so that it moves idly with the forward movement cartridge belt. This idle position is shown in FIG. 4. However, this Fig. is not correct, because only one of the star wheels 13 or 14 is uncoupled and not both at the same time as shown in FIG. 4.

To remove a jam, which can be caused by misfiring of a primer of a cartridge 15, the belt of the ammunition has to be moved into the next cartridge position in the direction of the weapon or the cartridge belt feeding device 9 which is separate from the weapon. For this purpose, a trigger 46 (FIG. 6) is actuated until the following steps automatically occur:

a. A star-shaped wheel 932 (FIG. 3*a*) of feed device 9 is switched from its firing position F into its "loading" position L, which is done by means of an hydraulic piston with an associated rack 930 and a gear 931 via a pivoted catch ratchet 942. The piston type rack 932 which is disposed in an hydraulic cylinder 931 is operated by actuation of the trigger 46 which operates the valves 930*a* and 930*b* which connect the oil lines 26 and 36 (as described in connection with FIG. 5) via lines 930*a'* and 930*b'* to the respective cylinder ends of the rack 930.

b. The gear drive 20 of FIG. 5 is retracted from its disconnected front surface gear means 16, i.e., without retracting a cartridge 15.

c. The same gear drive 20 is coupled at its front surface gear means or clutch 16, and pushed forwardly again in the direction of feed device 9 and the weapon. Thereby, the belt can only be moved forwardly by one cartridge so that automatic operation is blocked. Trigger 46 is then released again. Rack 20 is disconnected from its front surface gear means 16, and pushed forwardly without taking a cartridge (ammunition) as shown in FIG. 4.

The feeder device is then switched into its firing position F. FIG. 3*a* also shows the third position E, i.e., the withdrawal or the discharging position of feed device 9, this direction being shown by an arrow in FIG. 3.

Further, by way of explanation, after a bullet which did not fire was taken from the bullet supply belt 9, no transporting of the supply belt takes place. Therefore, the weapon cannot take a bullet from bullet supply belt 9 after the weapon is cocked. The removal of such a jamming is done as follows. By actuating trigger 46 the changing to the isolated bullet supply belt 9 as described in section a above.

Sprocket piston 20/21 returns in direction C, whereby the spur gears 17, 18, 19 and the uncoupled clutch 16''' turn. At this point clutch 16 couples into star wheel 13. Sprocket piston 20/21 returns in direction D (FIG. 10) and moves the next cartridge. Now clutch 16 uncouples and sprocket 20/21 moves back into its original position C (FIG. 9). Clutch 16 on wheel 17 remains uncoupled. The cartridge supply belt 9 again switches into the firing position. The weapon is ready for firing after the trigger 46 is released. At this point the coupling 16 is always open, whereby the cartridges are supplied to the star wheel and to the cartridge supply belt 9.

Referring further to FIG. 3*a*, the starting position for switching of the cartridge belt supply 9 is actually the charging position E. From this position, the sprocket piston 930 moves upwardly to position L whereby the switching cams are also switched on charging position L by means of sprocket wheel 931 actuating the associated valve. Actuation of the sprocket piston 930 into position F actuates the changeover of the cartridge belt supply to the firing position via its associated valve. Likewise, the valve associated with position valves L is actuated in the corresponding position L of the piston 930.

Sprocket rack 930 moves only when changing from one type of ammunition to a different type of ammunition, i.e., not when supplying automatically the individual cartridges during shooting.

FIGS. 3–6 indicate that the two cartridge belts constitute two independent firing possibilities that can be selected by the levers 40, 41. Either of them, when in the upper position, activates the respective belt feed; and in the lower position, operates the cartridge withdrawal.

Relating now again to FIG. 4, only one portion of clutch 16 with the associated open clutch 17 can be engaged together at a particular time. The other has to be disengaged or else cartridges would be fed from both belts, and the tongue would prevent this (thus, it cannot allow the feed from both belts).

Both the regular forward feed of the successive cartridges is possible, while they are still carried on the respective belts 11, 12, as well as withdrawal or rearward movement in the event of a jam, namely, in that appropriate operation of the drive means and of the tongue 10, forming part of the switching means, allows the respective belt portion with the jammed cartridges thereon to be withdrawn from between the tongue 10 and the input of the weapon to behind the tongue. The input is also separate from the weapon.

If this were not so, the inventive feeding device of the invention could not operate because one would be unable to activate the switch, with one or more cartridges possibly still jamming the same. The adjustment tongue 10 is pivotable, as can be seen in FIG. 3. The first and second star or sprocket wheels 13, 14 are pivoted by the drive means.

One of the sprocket wheels 13 or 14 can idle, to allow the cartridges to be fed forward, or it can be driven positively backwards, to withdraw possibly jammed cartridges. The mechanism allows these jammed cartridges to be withdrawn, and together with the associated belt portion, which eliminates any danger of a cartridge possibly remaining at the weapon input. The withdrawal of such cartridges is complete from between tongue 10 of the switching means, namely, to behind the tongue.

The device of the present invention does not advance the cartridge into the breech, which would be part of the weapon, but toward a common input, separate from the weapon, constituting for example, a channel.

FIG. 3 shows the control in operation as set by FIG. 5. The lever 41 (FIG. 6) is in the "up" or firing position. Only one lever can be up; but both can be down if the device is to be cleared of both belts and the cartridges thereon (FIG. 8). The details of FIG. 3 are not repeated in FIGS. 7 and 8, but all other identifiable parts are shown with their reference numerals corresponding to FIGS. 3 and 5.

FIG. 3 shows the device only in one particular condition or phase, namely, when operated in a "fire 2" position, that is the cartridges are being fed from belt 11, passing star wheels 13, and onto star wheel 932, and the weapon mechanism 7. It can be seen that only the lower clutch 16*a* of the two clutches 16 is activated, while the other upper clutch 16*b* is free to idle, where the belt is allowed to be fed, in accordance with the energized and deenergized positions of the cylinders 32. The lines 16' in FIG. 3 merely schematically indicate the cylinders 16' on which the star wheels 13 or 14 are mounted (note FIG. 4), the right ends of the cylinders constituting the left-hand push of clutch 16. The cam discs bearing the letters "E", "L" and "F" (FIG. 3a) correspond to the above explained operative modes.

FIG. 7 shows the "fire 1" position, that is, the cartridges being fed from the other belt 12, and most of the controlling elements reversed in their activated and deactivated conditions, including the levers 40, 41 (not shown). The pistons 21 (not shown) are now at their other end positions (coaxially reverse from that of FIG. 5); the other clutch 16*b* is now engaged and the clutch 16*a* open; and the tongue 10 is pivoted upwardly, i.e., switched over, as can be seen in FIG. 10.

FIG. 8 shows both systems set for "withdrawal", with both clutches 16*a* and 16*b* engaged to prevent untoward slippage of the belts, and both sprocket or star wheels being rotated in reverse, thereby moving the belts toward the storage bins or the like. Both clutches 16 are closed. Both pistons 21 of FIG. 5 (not shown) are at the extreme righthand sides of the cylinders 22.

All of these operations are controlled hydraulically in a known, automatic manner, as is conventional per se.

The sprocket or star wheels 13, 14 are freely rotatable in the firing position, but are driven in reverse when the cartridges are to be withdrawn; the clutches 16, 17 operate accordingly. In the forward or feeding phase, only the star wheel 932 is activated which transports the cartridges. In the discharging or withdrawing phase, both star wheels 13, 14 have to be arrested so that the weight of the belts does not pull the same out of the mechanism.

Referring now to FIGS. 11 and 12, the tongue 10 is maintained upwardly by a spring 10a and is pivotably mounted to the right and left in the housing. The control thereof is done by the inserted cartridge belt 11 or 12 (see FIG. 3).

While only an exemplary embodiment of the present invention has been shown and described, it will be obvious to those skilled in the art that many changes and modifications may be made thereunto without departing from the spirit and scope of the invention.

What is claimed is:

1. A device for selectively feeding two ammunition cartridge belts to an automatic weapon, such as a rapid-firing cannon, wherein two cartridge belt feeders are combined before a common input of the weapon, the device comprising, in combination: first and second, adjacently mounted sprocket wheel means engaging successive cartridges carried by the respective belts; drive means coupled to said wheel means for selectively releasing one of said wheel means for movement of said cartridges in the forward direction, toward the weapon, for regular feed and firing of the cartridges, together with the associated one of the belts to the input of the weapon, which is separate therefrom, and for turning one of said cartridge belts for movement in the rearward direction, away from the weapon, for withdrawing the cartridges when jammed, together with the respective carrying belt portion; switching means mounted adjacent to said wheel means, separate from the weapon, receiving the successive cartridges from said one wheel means, and including a pivotable adjustment tongue disposed between said first and said second wheel means, for selecting one of said belts with the cartridges from one of said wheel means; third sprocket wheel means for receiving the cartridges from said one wheel means and advancing them; and a hydraulically operated gear rack coupled to said third wheel means for positively feeding the cartridges toward the input; the operation of said drive means and of said tongue of the switching means allowing the belt portion with the jammed cartridges to be withdrawn from between said tongue and the input to behind said tongue.

2. The device as defined in claim 1, wherein said sprocket wheel means each include a pair of spaced-apart sprockets for receiving the successive cartridges therebetween.

3. The device as defined in claim 1, wherein said drive means includes first and second hydraulically operated gear racks; first and second gear trains associated with said racks; first and second hydraulic gear clutches selectively coupling said gear trains to the respective sprocket wheel means; and a hydraulic control system connected to said first and second gear racks and said gear clutches for selectively allowing forward rotation of the respective wheel means, or imparting thereto rearward rotation for withdrawal of the jammed cartridges.

4. The device as defined in claim 3, wherein at least one of said gear racks includes a hydraulic piston.

5. The device as defined in claim 3, further comprising a trigger coupled to said hydraulic control system for operating said sprocket wheel means to permit removal of the jammed cartridges.

6. The device as defined in claim 5, further comprising means for pivoting said third sprocket wheel means between firing and loading phases in feeding the successive cartridges.

7. The device as defined in claim 3, wherein the weapon includes an elevation gear pivot bearing ring for supplying the ammunition, and said first and second gear racks are mounted in the opening of and below said bearing ring.

* * * * *